United States Patent [19]

Bouchard et al.

[11] 4,212,168

[45] Jul. 15, 1980

[54] POWER PRODUCING DRY-TYPE COOLING SYSTEM

[75] Inventors: Craig T. Bouchard, Westmont; Elmer W. Rothrock, Hinsdale; James B. Maher, Oak Brook, all of Ill.

[73] Assignee: Chicago Bridge & Iron Company, Oak Brook, Ill.

[21] Appl. No.: 942,766

[22] Filed: Sep. 15, 1978

[51] Int. Cl.[2] ..... F01K 9/00; F01K 23/04

[52] U.S. Cl. ..... 60/661; 60/655; 60/692

[58] Field of Search ..... 60/655, 690, 691, 692, 60/693, 661

[56] References Cited

U.S. PATENT DOCUMENTS

| | | | |
|---|---|---|---|
| 3,820,336 | 6/1974 | Schwarzenbach | 60/693 |
| 3,851,474 | 12/1974 | Heller et al. | 60/690 X |
| 4,037,413 | 7/1977 | Heller et al. | 60/655 |

*Primary Examiner*—Allen M. Ostrager

*Attorney, Agent, or Firm*—Merriam, Marshall & Bicknell

[57] ABSTRACT

A dry-type cooling system for condensing steam in a steam operated electric power generating plant and disposing of the heat withdrawn, by converting some of the heat to a form of power or work, such as electric power, and rejecting some of the heat to the air. The system requires a power input at relatively high ambient air temperatures, but such power consumption is offset by power produced during cooling with ambient air at lower temperatures.

The cooling system utilizes a closed loop containing a suitable refrigerant fluid. The loop contains a steam condenser in the hot-well of a steam system of an electric generating plant, and a heat exchanger in a cooling tower through which air enters at atmospheric temperature and exits at an elevated temperature. The closed loop is branched to incorporate two consecutively operable cooling cycles employing the same refrigerant fluid. One of the cooling cycles operates when the atmospheric temperature of the air is comparatively high, and the other cooling cycle operates when the atmospheric temperature of the air is comparatively low, such as below 80° F. The cooling cycle operating at the higher temperatures is a power consuming cycle while the cooling cycle operating at the lower temperatures is a power generating cycle. Overall, efficiency of an electric power plant may be increased 2 to 3%. The cooling system produces as much as twelve times more power than it consumes over a yearly period. The cooling system employs no water so there is no water loss or environmental disturbance and no thermal pollution.

17 Claims, 2 Drawing Figures

POWER PRODUCING DRY-TYPE COOLING SYSTEM

This invention relates to processes and systems for cooling. More particularly, this invention is concerned with processes and apparatus useful for removing heat from a fluid, such as waste steam.

There are many instances in which it becomes necessary to remove heat from industrial plants, particularly heat from electric power generating plants. The heat removal is generally accomplished by means of an intermediate cooling fluid, which can be a gas but most often is a liquid i.e. water, although other liquids might be used. After the intermediate cooling liquid has absorbed heat it can be disposed of in a lake or river, if water, or be reused. If the cooling liquid is to be reused its heat content must be reduced to an acceptable level. This can be achieved by a number of procedures but for large scale cooling it is common to cool the liquid, in most cases water, in a cooling tower which employs evaporation.

A typical cooling system can be illustrated further by reference to a power generating plant. In the production of electric power, heat is first produced by nuclear energy or combustion of a fossil fuel such as oil, gas or coal. The heat produced is then used to convert water into steam. The steam is conducted at high pressure to a turbine which it drives. The turbine is, of course, coupled to a generator which produces electric power. The spent steam from the turbine is condensed in a hot-well by indirect heat exchange with cooling water and then recycled and reheated to steam again.

The cooling water picks up heat in condensing the steam. The heated water produced is sometimes disposed of into rivers and lakes but this is undesirable in certain areas because it causes the temperature of natural bodies of water to rise excessively leading to ecological imbalance.

As an alternative, many power generating plants cool the hot water in an evaporative cooling tower by contacting it with ambient air. Huge hyperbolic natural or mechanical draft cooling towers are extensively used for this purpose. While most of the hot water is cooled in this manner, a substantial amount is expelled as water vapor which may form artificial clouds leading to fog, ice and other problems in addition to the loss of fresh water which is increasingly scarce.

An evaporative cooling tower serving a 1000 megawatt electric generating plant may lose as much as 900,000 gallons of water per hour into the atmosphere. Also, the vapor expelled may contain solids picked up by circulation causing additional environmental problems.

To reduce or avoid the problems and disadvantages present in the described method, various alternative cooling systems have been proposed. Delahunty in U.S. Pat. No. 3,788,385 discloses the use of solid particulates as a primary coolant which become melted and liquid while providing cooling by absorbing heat from hot cooling water. After the coolant has absorbed heat and has become liquefied it is reconverted by cooling into solid particulates. The solid particulates can then be recycled into heat exchange with the hot material. Cooling of the liquefied solid material is accomplished in a cooling tower by means of air flow. Contact with air flowing through the tower cools the material to solid particulate form. The particles settle by gravity and are reused for further cooling. Only hot air need be expelled from the tower under properly controlled operation. While this process is operable, it requires a larger power consumption than is usually acceptable economically and a greater capital investment than is desired.

Various dry-type cooling systems have also been proposed. In one such system, ammonia is used in a closed loop refrigeration-type cycle to absorb heat in the hot-well of a power generating plant and then reject heat in a cooling tower where air absorbs the heat from the ammonia coolant. This process is not very efficient in comparison to an evaporative or once-through cooling system. One of the shortcomings of the system is that the temperature of the ammonia refrigerant entering the cooling tower is close to the temperature of the hot-well which in power plants ranges between 100° and 135° F. When the weather is hot and the ambient air flowing through the tower, for example, is about 80° F. or above, the temperature differential between the ammonia coolant and the ambient air is smaller than desired for efficient heat exchange. Also, the cooling tower cannot be designed for natural draft because of low differential temperatures between ambient air and the coolant temperature. To promote more efficient heat exchange in the cooling tower, the hot-well temperatures may be increased but this leads to a higher back pressure in the hot-well and lower turbine efficiency with a corresponding drop in power output. When the air temperature is lower than 80° F., better cooling is effected but the high costs of providing for peak ambient temperatures make the system uneconomical. There is, accordingly, a need for a system or apparatus, and an appropriate method, for effecting steam condensation and heat rejection by dry-type cooling in an electric power generating plant which permits economical operation by means of an overall low power consumption and a capital investment competitive with other described systems.

According to the subject invention there is provided a dry-type cooling system for condensing steam in a steam operated electric power generating plant and disposing of the heat withdrawn, by converting some of the heat to a form of power or work, such as electric power, and rejecting some of the heat to the air. Although the system requires a power input at relatively high ambient air temperatures, such power consumption is more than offset on overall balance by the power produced in the period of cooling with ambient air at lower temperatures.

The cooling system of the subject invention utilizes a closed loop containing a suitable refrigerant fluid. Included as part of the loop is a steam condenser adapted to be positioned in the hot-well of a steam system of an electric power generating plant, and a heat exchanger adapted to be located in a cooling tower through which air enters and flows at atmospheric or ambient temperature and exits at elevated temperature. The cooling capacity or duty of the heat exchanger and the cooling tower in which it is to be placed, are designed to provide adequate cooling of the refrigerant fluid on those days of high ambient or atmospheric temperature when the apparatus and method of the invention, as subsequently more fully described, are in operation.

The closed loop is suitably branched or bifurcated in such a way as to incorporate two individually and alternatively but consecutively operable cooling cycles employing the same refrigerant fluid. One of the cooling cycles is designed to operate when the atmospheric temperature of the air is comparatively high, such as above 80° F., and the other cooling cycle is designed to operate when the atmospheric temperature of the air is comparatively moderate, such as below 80° F. The cooling cycle operating at the higher temperatures, called a first cooling cycle for reference purposes, is a power consuming cycle while the cooling cycle operating at the lower temperatures, called a second cooling cycle for reference purposes, is a power generating cycle. Furthermore, it is calculated that the net power obtained from the power generating second cycle will be 2 to 3% of nominal plant capacity over a year of operation so that condensation of steam in the hot-well can be effected with a new gain in power production, rather than with a net power consumption as with prior art cooling systems. Over a yearly period, the entire cooling system is expected to produce as much as twelve times more power than it consumes. Of course, the cooling system of the invention employs no water so it is inherently effected without water loss or environmental disturbance and without thermal pollution.

Apparatus is provided by this invention for selectively operating the two described cooling cycles on an alternative but consecutive basis, directly or indirectly according to the prevailing ambient air temperature. A compressor and an expander are included in the closed loop parallel to each other between the condenser in the hot-well and the heat exchanger inlet in the cooling tower. In addition, a liquid pump and an expansion valve are included in the closed loop parallel to each other between the heat exchanger outlet in the cooling tower and the condenser inlet in the hot-well. Controls are included in the system so that the compressor and the expansion valve operate together, with the expander and the liquid pump inactive, in the first cycle. In the second cycle the expander and the liquid pump operate together, with the compressor inactive and the expansion valve closed.

The first cooling cycle, in which the compressor operates, has the highest pressure in the heat exchanger and the lowest pressure in the condenser. However, in the second cooling cycle the highest pressure is in the condenser and the lowest pressure is in the heat exchanger.

Regardless of which cooling cycle is in operation at any one time in a complete installation, it is desirable to have the refrigerant fluid evaporate in the condenser and leave the condenser as a vapor close to its dew point. It is also desirable to have steam in the hot-well condense at a controlled temperature and pressure. To achieve these conditions the temperature and pressure of the refrigerant fluid at the outlet of the condenser are held constant and the refrigerant flow through the condenser is allowed to vary. This is necessary since the temperature of the refrigerant flow at the inlet to the condenser will vary with ambient temperature. The pressure of the refrigerant liquid entering the condenser will be controlled at a value corresponding to the dew point pressure of the vapor leaving the condenser. By controlling refrigerant flow, conditions in the hot-well (i.e. pressure and temperature) can be carefully controlled in contrast to other cooling systems. Therefore, if desired, a rise in turbine back pressure, along with a correspondingly lower power output, can be prevented.

In the first cooling cycle, operating in a complete installation above a predetermined or certain ambient air temperature, the refrigerant vapor from the condenser is fed to the compressor, which increases the refrigerant pressure and temperature. Running the compressor, of course, requires power input. The pressurized heated refrigerant vapor is fed from the compressor to the heat exchanger in the cooling tower. The work of compression adds to the cooling duty of the cooling tower and subtracts from the output of the electric power generating plant. Although compression will lead to an expected approximately 3% increase in tower duty, this will be more than offset by equipment savings which are achieved because 100% of the heat can be rejected at temperatures warmer than the hot well. The compressed refrigerant, which is at a temperature above the ambient air temperature and the hot-well temperature, condenses in the heat exchanger and the ambient air flowing through the cooling tower is heated, such as to about the hot-well temperature, i.e. the temperature approximating that of the spent steam, to effect the heat rejection. The condensed refrigerant is then fed through the loop to the expansion valve. The pressure of the liquid refrigerant drops as it flows through the expansion valve to a lower pressure equal to the pressure in the condenser. The first cooling cycle is completed when the refrigerant enters the condenser and is vaporized in it by condensing steam.

The first cooling cycle is used only when the ambient air is comparatively hot. When the air temperature drops, such as at night and during cool weather periods, the second cooling cycle, which produces power, is automatically placed in operation and the first cooling cycle is put on inactive standby. Since a hot ambient air temperature is used for the apparatus design condition, excess cooling tower capacity is inherently available during normal and cooler weather. This makes use of a compressor unnecessary in the second cooling cycle.

The second cooling cycle operates by directing the hot refrigerant vapor from the hot-well condenser to the expander. The thermal energy of the refrigerant vapor drives the expander which, in turn, is operably connected to an electric generator or other means to produce power or work. In this way power or work is produced during operation of the second cycle. The expanded refrigerant vapor, which is still hot upon exiting the expander at a lower pressure, is fed to the heat exchanger in the cooling tower in which it is cooled and condensed. While the refrigerant pressure is lowered by passing through the expander, its pressure is maintained high enough to effect condensation in the heat exchanger in the cooling tower by rejection of heat to ambient air. The cooled refrigerant liquid is then fed from the heat exchanger to the liquid pump from which it is directed under pressure to the hot-well condenser.

The dry-cooling apparatus and method of this invention are to be used in a complete installation with a cooling tower which has a capacity or duty to reject to ambient temperature air heat in an amount equal to the heat rejected to the refrigerant fluid in the hot-well steam condenser at the highest ambient air temperature at which the second cooling cycle or expander power generating cycle operates. At higher ambient air temperatures, the cooling capacity of the tower is insufficient to condense the refrigerant unless its temperature is increased, such as occurs when the first cooling cycle goes into operation and the compressor increases the pressure and temperature of the refrigerant fluid.

The system is designed so that the power generating or second cooling cycle will be in operation most of the time. During operation of the second cooling cycle, the total heat rejected in the cooling tower heat exchanger will equal the heat rejected in the hot-well condenser minus the heat rejected in the expander operation to generate power or other work. This can be represented by the equation: Q (cooling tower total)=Q (hot well)−Q (expander). As the temperature of the ambient or atmospheric air increases, the heat converted to power or work by the expander continuously decreases as the temperature differential between the expanded refrigerant fed to the heat exchanger and the ambient air flowing through the cooling tower is narrowed. Ultimately no power or work will be generated by the expander. At that point the heat rejected by the cooling tower heat exchanger will equal the heat rejected to the refrigerant in the hot-well condenser. In the above equation Q (expander) would equal zero (0) so that the equation would then read: Q (cooling tower)=Q (hot well). At, or somewhat before this condition is reached, a crossover is effected from the second cooling cycle, which is inactivated, to the first cooling cycle, which is activated.

Operation of the first cooling cycle can be represented by the following heat (Q) balance formula: Q (cooling tower total)=Q (hot-well)+Q (compressor). The heat in-put by the compressor raises the temperature of the refrigerant fluid above the temperature of the hot-well and to a temperature sufficiently above the hot ambient air (air above 80° F., for example) to permit efficient heat rejection in the cooling tower and condensation of the refrigerant fluid in the heat exchanger located therein. Desirably, a compressor with a variable output which can continuously increase the refrigerant pressure with increase in ambient temperature would be most suitable. However, a compressor operating with incrementally increasing pressures coordinated with increases in ambient air temperature would also be suitable. Furthermore, a single steady state compressor which brings the refrigerant vapor to the highest pressure and temperature needed to operate the first cycle, up to a maximum design ambient temperature, would also be suitable. Any suitable power source, such as steam, gas or electricity, can be used to power the compressor.

Cross-over from one to the other described cooling cycles can be readily effected by use of any suitable control means. The first or compressor cooling cycle should be put in operation by control means when the temperature of the atmospheric air flowing through the cooling tower is too high to effect efficient heat exchange and condensation of the refrigerant in the heat exchanger in the cooling tower without compressing the refrigerant. Furthermore, the second or expander cooling cycle should be put in operation by control means when the temperature of the atmospheric air flowing through the cooling tower is low enough to condense the refrigerant in the heat exchanger at a pressure lower than the pressure of the refrigerant exiting the condenser.

The operation of this invention can be controlled manually using such gauges, valves and the like as may be appropriate to provide information to a person who can switch the cooling system from one cycle to the other manually.

One of the simplest control means suitable for use is based on the ambient or atmospheric air temperature in which a thermostat will automatically switch one cycle on and the other off when the ambient air goes above or below a predetermined temperature.

Other methods of control can, of course, be used. Thus, a suitable control system can be based on the temperature of the refrigerant leaving the condenser, the differential pressure between the higher pressure upstream of the compressor or expander and the lower pressure downstream of the compressor or expander, the liquid level of the refrigerant in a reservoir, the temperature in the cooling tower, or a combination of these and other control systems.

One highly suitable control system for use in the system of this invention is based on the temperature of the refrigerant leaving the condenser in the hot-well. This temperature is advisably fixed in designing the system to be about 5% below the hot-well temperature. Upon fixing the refrigerant temperature at that point and controlling the flow, the pressure is inherently fixed to be that at which the refrigerant is a saturated vapor at its dew point.

To use the temperature of the refrigerant leaving the condenser to control operation of the system a temperature controller can be placed in the closed loop just after the condenser outlet. The temperature controller can be operatively connected to a valve in the closed loop downstream of the heat exchanger to regulate the rate of flow of refrigerant to the liquid pump or the expansion valve.

The control system can also include a liquid level controller which responds to the liquid refrigerant level in a reservoir at the outlet side of the heat exchanger. The liquid level controller either throttles the liquid pump when the second cycle is operating, or throttles the expansion valve when the first cycle is operating, to thereby regulate the pressure of the refrigerant which is fed to the condenser. The liquid level controller thereby also regulates the pressure of the refrigerant in the cooling tower heat exchanger and at the compressor/expander discharge. In this way, the pressure can be controlled to assure complete condensation of the refrigerant in the cooling tower.

In addition to the temperature controller and liquid level controller, the cooling cycles are controlled, in one form of a complete system, by a differential pressure measuring device which responds to changes in the differential pressure between the higher pressure upstream of the expander/compressor and the lower pressure downstream of the expander/compressor. As the ambient air temperature increases it will not provide the amount of cooling it does at lower temperatures so that the refrigerant will not condense as rapidly in the heat exchanger, thereby increasing the pressure in the heat exchanger. This results in a decrease in the differential pressure across the expander. When the differential pressure decreases to a predetermined point, the differential pressure measuring device inactivates the second cooling cycle and activates the first cooling cycle comprising the compressor and the expansion valve. When the ambient air subsequently cools enough and the differential pressure increases to or slightly above the predetermined point for which the device is set, the first cooling cycle will be inactivated and the second cycle, comprising the expander and the liquid pump, activated. A selector switch activated by the differential pressure measuring device in turn directs the liquid level control signal either to the expansion valve or to the liquid pump. Such a control system, obviously, is indirectly but inherently responding to ambient air temperature changes.

The composition of the refrigerant fluid must be selected so that it will vaporize by heat rejection from the steam in the hot-well and be condensed by passage through the heat exchanger in the cooling tower regardless of which cycle is in operation. In such a system the refrigerant may leave the hot-well condenser as a saturated vapor at its dew point and it may leave the heat exchanger in the cooling tower as a saturated liquid at its bubble point.

In designing a cooling system employing this invention, the pressure v. enthalpy curves for various refrigerants are examined for optimum refrigerating effect and optimum compression and expansion differential enthalpies. The temperature v. enthalpy characteristics of the refrigerant should provide optimum heat exchange in the cooling tower.

Refrigerants such as ammonia, propane, butane and other hydrocarbons which are gases at atmospheric temperatures and pressures can be used along or in suitable admixtures which are compatible. A particular refrigerant fluid which can be used in the described system of this invention, such as for condensing waste steam at 100° F. to 135° F. in a hot-well of an electric power generating plant, is isobutane alone or isobutane containing up to about 10 mol percent propane or other mixtures. Reference is made to Maher et al. U.S. Pat. No. 3,914,949 for further information on a mixed refrigerant single loop refrigeration cycle.

SUMMARY OF THE DRAWINGS

Figure 1:
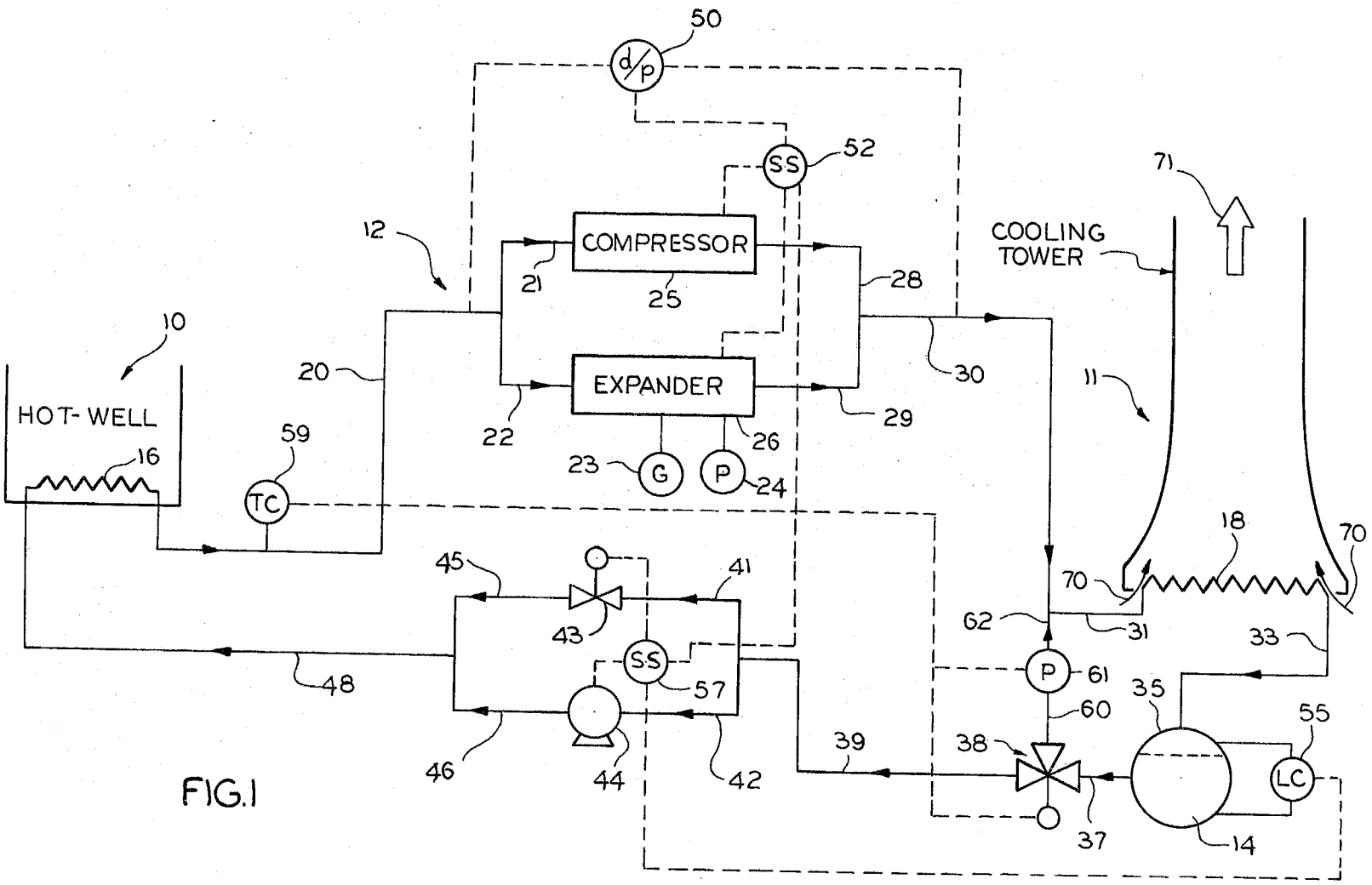
FIG. 1 is a diagrammatic drawing illustrating the two cooling cycles in combination with a hot-well and a cooling tower, and a control system for alternatively operating the cycles.

With reference to FIG. 1 of the drawings, the hot-well 10 is intended to represent that part of a steam driven electric generating power plant in which exhausted or spent steam, usually at a temperature of about 100° to 135° F., is condensed to water. The hot-well will, of course, be enclosed and operate typically at a back pressure of about 1 to 5 in. of mercury.

The cooling tower 11 is desirably of a natural draft type although it can be a mechanical draft tower in which air blows up through the tower. In both types of towers the ambient or atmospheric temperature air 70 enters at the bottom of the cooling tower and the heated air 71 flows out the top. The tower can be a steel or concrete shell having its bottom above ground level so that air can enter.

Extending from the hot-well 10 and the cooling tower 11 is a closed loop 12 containing a refrigerant fluid 14. The closed loop includes a steam condenser 16 located in hot well 10 and a heat exchanger 18 located in cooling tower 11. Refrigerant vapor is conducted from condenser 16 by conduit 20 to either conduit 21 which feeds it to compressor 25, or to conduit 22 which feeds it to expander 26. The refrigerant vapor is fed from compressor 25 by conduit 28 to conduit 30. Similarly, refrigerant vapor is fed from expander 26 by conduit 29 to conduit 30. Conduit 30 in turn feeds the refrigerant vapor to conduit 31 which is in communication with heat exchanger 18.

After passing through the heat exchanger 18, conduit 33 delivers the condensed refrigerant liquid to vessel 35 which holds a volume of refrigerant in the liquid state. The refrigerant liquid is fed by conduit 37 through three-way valve 38 to conduit 39. Conduit 39 delivers the refrigerant liquid to either conduit 41 or to conduit 42. Liquid refrigerant is fed by conduit 41 through expansion valve 43 to conduit 45 which delivers it to conduit 48. Liquid refrigerant is fed by conduit 42 to liquid pump 44 which delivers it to conduit 46 in communication with conduit 48. Conduit 48 delivers the liquid refrigerant to the inlet side of steam condenser 16 in which the refrigerant is vaporized by heat exchange with the spent steam in the hot-well.

The previously described first cooling cycle, which is the power consuming cycle, as illustrated by the embodiment shown in FIG. 1 is composed of condenser 16, conduits 20 and 21, compressor 25, conduits 28, 30 and 31, heat exchanger 18, conduit 33, vessel 35, conduit 37, valve 38, conduits 39 and 41, expansion valve 43, and conduits 45 and 48.

The previously described second cooling cycle, which is the power generating cycle, as embodied in FIG. 1 is composed of condenser 16, conduits 20 and 22, expander 26, conduits 29, 30 and 31, heat exchanger 18, conduit 33, vessel 35, conduit 37, valve 38, conduits 39 and 42, liquid pump 44, and conduits 46 and 48.

The expander 26 can be used to provide power or to perform work. Thus, it can be used to drive electric generator 23 and the electricity so produced can be fed to transmission lines, used to charge batteries or be converted to heat and stored as thermal energy for subsequent use. Expander 26 can also be used to operate pump or compressor 24 which can be used to compress a gas or to pump water to storage for later use, such as in electric generation. The expander 26 can also be used to power fuel cells or drive fans.

FIG. 1, in addition to illustrating each of the cooling cycles, illustrates diagrammatically a control system which effects automatic cross-over from one cooling cycle to the other, and a system for regulating refrigerant flow to condenser 16 using a by-pass loop for the liquid refrigerant.

The cooling system of the invention is advisably controlled so as to have refrigerant vapor at a uniform or constant temperature flow from condenser 16 into conduit 20. Since the temperature of the liquid refrigerant in reservoir vessel 35 varies with the ambient air temperature it is necessary for flow of refrigerant to condenser 16 to be regulated to effect constant cooling in the hot-well. The temperature controller 59 is placed in conduit 20 and is responsive to refrigerant vapor temperature change. If the vapor temperature drops below a predetermined temperature a signal from temperature controller 59 operates three-way valve 38 to lower the flow to conduit 39 and to increase the flow of refrigerant liquid through the valve 38 to conduit 60 which feeds it to pump 61 which is also activated by temperature controller 59. Pump 61 delivers the liquid refrigerant to conduit 62 which then feeds it to conduit 31. In this way an excess of refrigerant liquid is prevented from flowing through conduit 39 and ultimately to condenser 16 and overcooling the hot-well. This by-pass loop will be in operation most of the time for either cooling cycle. The amount of refrigerant liquid circulated through the by-pass loop and pump 61 will increase as the ambient air temperature decreases.

A liquid level controller 55 is provided on refrigerant liquid reservoir 35. It is operably connected to controllers which separately throttle expansion valve 43 when the first cycle operates, and throttles liquid pump 44 when the second cycle is operating, to thereby vary the refrigerant pressure regardless of which cycle is operating.

The preferred control system as so far described has for its purpose the maintenance of a constant temperature at the condenser outlet. The cross-over from one cooling cycle to the other can be automatically controlled by a differential pressure-sensitive control 50 which responds to the pressure difference between the pressure in conduit 20 on the inlet side, and the pressure in conduit 30 on the outlet side, of the compressor 25 and expander 26. Selector switch 52 receives a signal from control 50 and automatically activates compressor 25 or expander 26 and expansion valve 43 or pump 44. The compressor is activated when the differential pressure in conduits 20 and 30 decreases to a predetermined level and expander 26 is activated when the differential pressure increases to or above a predetermined level. Regardless of whether the compressor 25 or the expander 26 is operating, the liquid level controller 55 which responds to the refrigerant liquid level in vessel 35 will automatically throttle, by means of controllers, either liquid pump 44 when the expander 26 is operating, or expansion valve 43 when compressor 25 is operating. Furthermore, the selector switch 57 is desirably made a slave to selector switch 52 so that the liquid pump 44 is activated when the expander operates, and the expansion valve is activated when the compressor operates.

The following Tables 1 through 3, which are to be considered together, present calculated operating conditions for a specific cooling system of the invention designed to maintain a hot-well at 134° F. with a back pressure of 5 in. of mercury and a heat rejection requirement of $4.30\times10^9$ BTU/hr at the hot-well. The system is also designed to have the refrigerant vapor leaving the condenser 16 at 129° F., an enthalpy of 8191 BTU/mol, and at 110.72 psia pressure. The calculations are based on a refrigerant which is 97% isobutane and 3% propane. The numbers at the top of the columns in parentheses are the same numbers used hereinabove to identify elements in the apparatus. The data in the columns indicates the conditions where those elements are located.

Table 1

| Ambient Air Temperature °F. | Refrigerant Vapor °F. (20) | Refrigerant Vapor psia (20) | Refrigerant Vapor °F. (30) | Refrigerant Vapor psia (30) | Refrigerant Vapor °F. (31) |
|---|---|---|---|---|---|
| 95 | 129 | 110.72 | 141.9 | 131.21 | 141.9 |
| 86 | " | " | 132.0 | 115.25 | 132 |
| 77 | " | " | 123.1 | 100.78 | 123.1 |
| 61 | " | " | 108.7 | 79.36 | 108.7 |
| 41 | " | " | 90.6 | 57.86 | 90.6 |

Table 1-continued

| Ambient Air Temperature °F. | Refrigerant Vapor °F. (20) | Refrigerant Vapor psia (20) | Refrigerant Vapor °F. (30) | Refrigerant Vapor psia (30) | Refrigerant Vapor °F. (31) |
|---|---|---|---|---|---|
| 2 | " | " | 52.5 | 28.33 | 52.5 |

Table 2

| Ambient Air Temperature °F. | Refrigerant Liquid °F. (37) | Refrigerant Liquid psia (37) | Refrigerant Liquid °F. (48) | Refrigerant Liquid psia (48) | Refrigerant Flow mols/hr $\times 10^5$ (48) |
|---|---|---|---|---|---|
| 95 | 140 | 131.21 | 127.26 | 110.72 | 6.48 |
| 86 | 130 | 115.25 | 127.04 | " | 6.12 |
| 77 | 120 | 100.78 | 120.10 | " | 5.81 |
| 61 | 103 | 79.36 | 103.12 | " | 5.36 |
| 41 | 82 | 57.86 | 82.12 | " | 4.90 |
| 2 | 40 | 28.33 | 40.14 | " | 4.21 |

Table 3

| Ambient Air Temperature °F. | Refrigerant Flow mols/hr $\times 10^5$ (62) | Enthalpy BTU/mol (37 & 48) | Enthalpy BTU/mol (30) | Enthalpy BTU/mol (31) | Cooling Tower Duty BTU/hr $\times 10^9$ | Horsepower | Air Discharge Temperature °F. (70) |
|---|---|---|---|---|---|---|---|
| 95 | 0 | 1558 | 8357 | 8357 | 4.41 | 49,830 | 135 |
| 86 | .36 | 1163 | 8230 | 7837 | 4.32 | 11,028 | 125.2 |
| 77 | .67 | 790 | 8099 | 7343 | 4.24 | −16,819 | 115.5 |
| 61 | 1.12 | 162 | 7567 | 6538 | 4.13 | −54,624 | 98.4 |
| 41 | 1.58 | −590 | 7558 | 5571 | 3.99 | −97,443 | 77.2 |
| 2 | 2.27 | −2029 | 6868 | 3751 | 3.74 | −174,960 | 35.9 |

Figure 2:
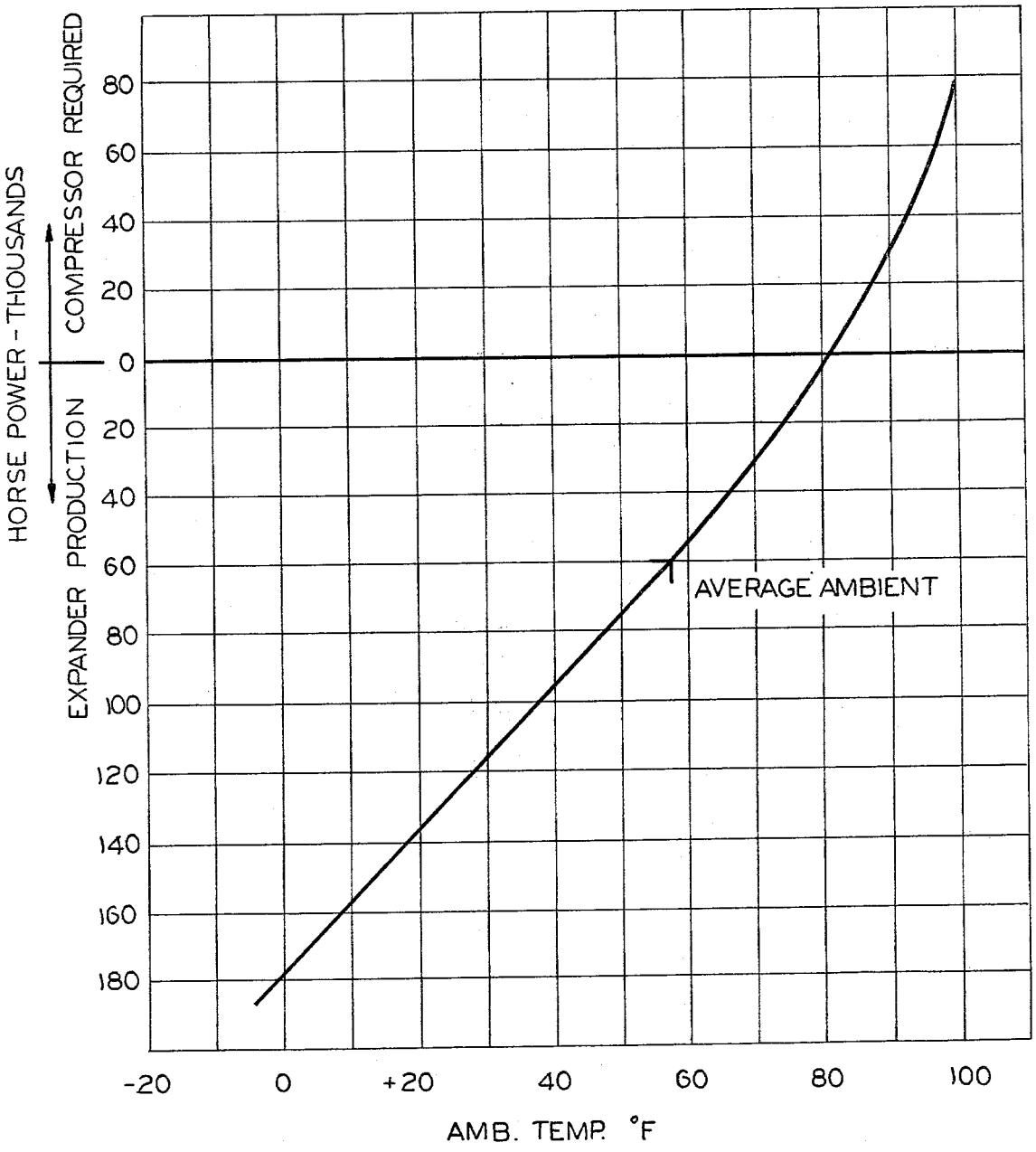
FIG. 2 is a graph illustrating typically the horsepower produced or consumed with change in ambient air temperature using the two cooling cycles.

The attached FIG. 2 illustrates on a graphical basis the power production of the expander cooling cycle, and the power consumption of the compressor cooling cycle, for the system for which the data in Tables 1 to 3 was calculated.

The dry-type cooling apparatus and method provided by this invention have a number of inherent advantages compared to prior systems used for heat disposal, as well as indirect advantages which flow from its nature. The following are some of the advantages which can be cataloged when the system is used in a power generating plant, although it should be understood that with any particular plant not all of the advantages may be simultaneously realized.

1. Plant Location—The power plant can be located in remote areas where large quantities of water are not available.

2. Thermal Pollution—There are no thermal discharges into rivers or lakes.

3. Water Conservation—In evaporative type cooling systems, large quantities of water are pumped to a cooling tower where evaporation occurs and the resulting moisture exits the tower into the atmosphere in the form of steam or a plume of partially condensed vapor. The dry system provided herewith requires no water and produces no plume.

4. Less Heat Exchange Surface Area—In other dry type systems, heat is rejected to the atmosphere at temperatures cooler than that of the hot-well. In this system, during the warm weather design condition, heat is rejected to the atmosphere at temperatures warmer than the hot-well. Thus, larger temperature differences between circulating refrigerant fluid and ambient air are achieved and this reduces the surface area required in the cooling tower heat exchanger.

5. Natural Draft In The Cooling Tower—Because temperatures higher than hot-well temperature are achieved in the cooling tower heat exchanger, ambient air is heated in flowing through the cooling tower heat exchanger to temperatures which produce more draft than is possible with most other dry cooling systems. This makes it possible to utilize natural draft rather than mechanical draft (fans) to overcome the pressure drop which occurs as ambient air is drawn through the heat exchanger installed at the base of the cooling tower.

6. Control of Hot-Well Conditions—In the conventional water cooled system, it is not practical to control the turbine back pressure. The plant is controlled by varying the firing rate and turbine inlet conditions. The back pressure varies day to night and seasonally with resulting variations in turbine efficiency and cooling tower capacity. With the system of this invention, it is possible to run the plant at a constant or programmed load and back pressure. This makes it possible to optimize power production and fuel consumption.

7. No Cold Weather or Cooling Water Treatment Problems—The refrigerant will not freeze at low ambient temperatures and is a clean, non-corrosive fluid.

8. Pipe Size—The refrigerant liquid conduits or pipes can be about one-half the diameter of circulating water pipes in conventional systems.

9. Better Heat Transfer Coefficients—Both in the hot-well and cooling tower, boiling and condensing film coefficients for the refrigerant are far greater than film coefficients achievable with water. Thus, for an equivalent surface area, closer temperature approaches can be used with the refrigerant. This makes it possible to reject heat to ambient at warmer temperatures. Thus, less compressor horsepower is required for hot days and more horsepower is produced at average or cool weather conditions.

10. Improvement in Overall Power Plant Efficiency—The cooling system is a net producer of power during the year, thereby increasing overall plant efficiency approximately 2 to 3%. A 40% thermal efficient plant could become a 43% plant with use of this cooling system.

11. Use of Steel For Cooling Tower Construction—Since only air contacts the cooling tower, other than rain or snow during inclement weather, the cooling tower will not be subjected to harsh, corrosive conditions when the system of this invention is used. The tower can therefore be made of steel.

12. Flexibility of Power Plant Design—The system of this invention allows substantial flexibility in plant design by not being tied down to a source of cooling water. The invention allows custom design of a cooling system according to the prevailing atmospheric conditions at the plant site. Varying the refrigerant according to site conditions will permit maximum cooling and power or work production. The energy from the second expander cycle can be used as appropriate to the plant site to generate power for transmission or storage or to perform work.

The foregoing detailed description has been given for clearness of understanding only, and no unnecessary limitations should be understood therefrom, as modifications will be obvious to those skilled in the art.

What is claimed is:

1. Apparatus for removal of heat from exhaust or spent steam from a steam driven electric generating power plant in which the steam must be condensed in a hot-well before the water can be reconverted to steam, comprising:

a closed loop containing a refrigerant fluid, a condenser having a refrigerant inlet and outlet in the closed loop and positioned to effect spent steam condensation in the hot-well by indirect heat exchange with refrigerant fluid flowing through the condenser, a heat exchanger having a refrigerant inlet and outlet in the closed loop and adapted to be located in a cooling tower to effect indirect heat exchange between refrigerant fluid flowing through the heat exchanger and atmospheric temperature air flowing through the cooling tower to cool the refrigerant fluid, a compressor and an expander positioned parallel to one another in the loop between the outlet of the condenser and the inlet of the heat exchanger, a liquid pump and an expansion valve positioned parallel to one another in the loop between the outlet of the heat exchanger and the inlet of the condenser, control means to activate the compressor and open the expansion valve, and inactivate the expander and the liquid pump, when the temperature of the atmospheric air flowing through the cooling tower is too high to effect efficient heat exchange and condensation of the refrigerant in the cooling tower heat exchanger without compressing the refrigerant, and control means to activate the expander and the liquid pump, inactivate the compressor and close the expansion valve, when the temperature of the atmospheric air flowing through the cooling tower is low enough to condense refrigerant vapor in the cooling tower heat exchanger at a pressure lower than the pressure of the refrigerant vapor exiting the condenser, to thereby extract energy by means of the expander for use in producing power or work.

2. Apparatus according to claim 1 in which the refrigerant is isobutane containing up to 10% propane.

3. Apparatus according to claim 1 in which the refrigerant is isobutane.

4. Apparatus according to claim 1 in which the refrigerant is propane.

5. Apparatus according to claim 1 in which the refrigerant is ammonia.

6. Apparatus according to claim 1 in which the refrigerant is a hydrocarbon, or mixture thereof, which is normally a gas at atmospheric temperatures and pressures.

7. Apparatus according to claim 1 in which the energy extracted by the expander is stored in various forms such as thermal energy, pumped water storage, compressed gas, or in batteries or fuel cells.

8. Apparatus according to claim 1 in which the expander is operably connected to an electric generator.

9. Apparatus according to claim 1 including a refrigerant liquid reservoir vessel in the closed loop between the heat exchanger and the inlets of the liquid pump and the expansion valve.

10. Apparatus according to claim 5 including a refrigerant by-pass loop including a conduit means communicating with the refrigerant liquid reservoir vessel and the closed loop ahead of the inlet side of the heat exchanger and after the compressor and expander, said by-pass loop including a second liquid pump for diverting refrigerant out of flow to the condenser when the air temperature is low to thereby maintain a substantially constant temperature and back pressure in the hot-well.

11. Apparatus according to claim 10 including a liquid level controller which senses the reservoir vessel liquid level, and means actuated by the liquid level controller to throttle either the liquid pump or the expansion valve.

12. Apparatus according to claim 1 including a temperature controller at the outlet side of the condenser responsive to the refrigerant vapor temperature and means responsive to the temperature controller to regulate flow of refrigerant to the condenser.

13. Apparatus according to claim 1 including a differential pressure control means which is responsive to the difference in the refrigerant vapor pressure ahead of and after the compressor and the expander, and a selector switch means responsive to the differential pressure control means to selectively operate the compressor or the expander.

14. Apparatus according to claim 1 in which the refrigerant composition is such that the refrigerant vapor condenses in the heat exchanger by heat rejection to air, producing air heated to a temperature close to the temperature of the hot-well.

15. Apparatus for removal of heat from exhaust or spent steam from a steam driven electric generating power plant in which the steam must be condensed in a hot-well before the water can be reconverted to steam, comprising:

a closed loop containing a refrigerant fluid, a condenser having a refrigerant inlet and outlet in the closed loop and positioned to effect spent steam condensation in the hot-well by indirect heat exchange with refrigerant fluid flowing through the condenser, a heat exchanger having a refrigerant inlet and outlet in the closed loop and adapted to be located in a cooling tower to effect indirect heat exchange between refrigerant fluid flowing through the heat exchanger and atmospheric temperature air flowing through the cooling tower to cool the refrigerant fluid, a compressor and an expander positioned parallel to one another in the loop between the outlet of the condenser and the inlet of the heat exchanger, a liquid pump and an expansion valve positioned parallel to one another in the loop between the outlet of the heat exchanger and the inlet of the condenser, control means to activate the compressor and open the expansion valve, and inactivate the expander and the liquid pump, when the temperature of the atmospheric air available for cooling and condensing the refrigerant in the heat exchanger is above a predetermined temperature to thereby increase the pressure and raise the temperature of the refrigerant above the hot-well temperature and sufficiently above the temperature of the atmospheric air to effect efficient heat exchange and condensation of the refrigerant, and control means to activate the expander and the liquid pump, inactivate the compressor and close the expansion valve, when the temperature of the atmospheric air available for cooling and condensing the refrigerant in the heat exchanger is at or below the said predetermined temperature thus lowering the refrigerant pressure in the heat exchanger below the refrigerant pressure in the condenser to thereby extract energy, absorbed by the refrigerant from steam condensation, by means of the expander for use in producing power or work.

16. Apparatus for removal of heat from exhaust or spent steam produced in an electric generating power plant, comprising:

an electric generating power plant having a hotwell in which exhaust or spent steam is to be condensed to water by heat rejection before the water is reconverted to steam for subsequent electric generation, a cooling tower which uses air at ambient or atmospheric temperature for cooling, a closed loop containing a refrigerant fluid, a condenser having a refrigerant inlet and outlet in the closed loop and positioned in the hot-well to condense steam by heat rejection to a refrigerant fluid flowing through the condenser, a heat exchanger having a refrigerant inlet and outlet in the closed loop and located in the cooling tower to effect indirect heat exchange between refrigerant fluid flowing through the heat exchanger and atmospheric temperature air flowing through the cooling tower to cool the refrigerant, a compressor and an expander positioned parallel to one another in the loop between the outlet of the condenser and the inlet of the heat exchanger, a liquid pump and an expansion valve positioned parallel to one another in the loop between the outlet of the heat exchanger and the inlet of the condenser, control means to activate the compressor and open the expansion valve, and inactivate the expander and the liquid pump, when the temperature of the atmospheric air flowing through the cooling tower is too high to condense the refrigerant without increasing its pressure and temperature by operation of the compressor, and control means to activate the expander and the liquid pump, inactivate the compressor and close the expansion valve, when the temperature of the atmospheric air is sufficiently low to allow expansion of the refrigerant vapor from the condenser to a lower pressure, produce power or work, and achieve condensation of the refrigerant in the cooling tower.

17. A method of condensing spent steam to water which comprises:

indirectly rejecting heat from the steam to a refrigerant liquid in a closed loop to condense the steam and vaporize the refrigerant, and then consecutively and continuously either:

(A) expanding the refrigerant vapor through an expander to develop power when the atmospheric air is below a certain temperature, cooling the expanded refrigerant vapor by heat rejection to atmospheric temperature air to condense the refrigerant to liquid and returning the refrigerant liquid for use in steam condensation, or (B) compressing the refrigerant vapor to a higher temperature than the spent steam when the atmospheric air is above a certain temperature, cooling the compressed refrigerant vapor by heat rejection to atmospheric temperature air to condense the refrigerant to liquid, heating the air to a temperature approximating that of the spent steam, and returning the refrigerant liquid for use in steam condensation.

* * * * *

UNITED STATES PATENT AND TRADEMARK OFFICE

CERTIFICATE OF CORRECTION

PATENT NO. : 4,212,168

DATED : July 15, 1980

INVENTOR(S) : Craig Thomas Bouchard, Elmer Weyman Rothrock, and James Bernard Maher It is certified that error appears in the above-identified patent and that said Letters Patent are hereby corrected as shown below:

Column 3, line 14, "new" should be --net--; Column 7, line 19, "along" should be --alone--.

Signed and Sealed this

*Twenty-third* Day of *September 1980*

[SEAL]

*Attest:*

SIDNEY A. DIAMOND

*Attesting Officer*

*Commissioner of Patents and Trademarks*